United States Patent [19]

Sutliff et al.

[11] 4,273,520

[45] Jun. 16, 1981

[54] DEEP WELL PUMP

[76] Inventors: Wayne N. Sutliff; Jim L. Downen, both of 2931 Pierce Rd., Bakersfield, Calif. 93308

[21] Appl. No.: 96,066

[22] Filed: Nov. 20, 1979

[51] Int. Cl.[3] ..... F04B 47/02; F04B 21/04

[52] U.S. Cl. ..... 417/434; 417/554

[58] Field of Search ..... 417/434, 552–554

[56] References Cited

U.S. PATENT DOCUMENTS

| | | | |
|---|---|---|---|
| 2,625,882 | 1/1953 | Davis et al. | 417/553 |
| 3,102,495 | 9/1963 | Page | 417/434 |
| 3,267,872 | 8/1966 | Bloodoff | 417/259 |
| 3,384,179 | 5/1968 | Haines | 417/554 |

*Primary Examiner*—William L. Freeh

*Attorney, Agent, or Firm*—Dana E. Keech

[57] ABSTRACT

A pump barrel open at its lower end is coupled at its upper end by a tubular adapter assembly to the lower end of a pump tubing string, this assembly presenting an internal bevelled sealing-latching annulus, an axially bored pump head being radially expansively spring latched in a fixed axial sealed relation with the annulus to seal the upper end of the pump barrel from the adapter assembly to form a pump compression chamber surrounding a hollow polish rod extending upwardly from a plunger mounted on the lower end of the polish rod for reciprocation in the pump barrel, the plunger carrying tandem travelling valves close beneath its connection with the polish rod, the lower valve opening to receive oil through the barrel and plunger on the down stroke and concurrently delivering such oil into the compression chamber, the upper valve closing on the down stroke and opening on the up stroke during which the lower valve closes to expel oil trapped in the compression chamber upward through the upper valve into the lower end of the hollow polish rod which oil is discharged at the upper end thereof into the pump tubing string through the fitting adapting the polish rod to the lower end of the sucker rod.

2 Claims, 7 Drawing Figures

DEEP WELL PUMP

The invention enjoys the following unique advantages:

1. The pump barrel, tubular adapter assembly with locking sealing annulus, containing the axially bored pump head, the hollow polish rod extending slidably through this, the tandem valved plunger slideable in the pump barrel and connected to the lower end of the polish rod, all this, rest upon and are latched to the head sealing annulus and suspended from the tubing string as it is lowered dry into the well.
2. Oil flows upwardly through the plunger valves, as the pump approaches the well bottom, and into the pump tubing string.
3. The sucker rod is now run down the tubing string and connected with the polish rod whereupon pumping can be started.
4. To facilitate withdrawing the pump, the spring latch on the pump head may be released by lifting heavily on the sucker rod string causing the pump tube string to drain dry of oil collected therein so that the sucker rod string can be then unscrewed and removed separately from the tubing string and the latter then pulled dry giving easy access to the pump at the surface for effecting repairs.
5. After being serviced, the pump may be reinstalled by a reversal of the dry tubing string disassembling operation described, followed by reassembling the sucker rod string, screwing it onto the polish rod adapter and pressing downwardly through the sucker rod string to relock the pump barrel head onto the pump adapter assembly annulus, thus readying the pump to resume sucker rod operation from the surface.

SUMMARY OF THE INVENTION

Principal among the objects sought to be attained are the following:

1. Ease of dumping of fluid when the pump needs repair.
2. Expelling any gas trapped in the pump chamber at the top of the barrel on the upstroke of the pump by running in close vertical proximity the tandem pump plunger valves.
3. Facilitating the optional choice of initially running the pump tubing string in the well, carrying, suspended on its lower end, merely the tubular adapter, the bevelled annulus and the pump barrel, following which the sucker rod string is assembled, as it is lowered through the pump tubing string, with the hollow polish rod secured to the lower end of the sucker rod string and the spring latching pump head slidingly mounted on the hollow polish rod while the lower end of the latter connects to and supports the pump plunger slideably limited in its downward movement by an internal annular stop screwed onto the bottom end of the pump barrel.
4. Facilitating the alternate choice of initially assembling and supporting all elements of the invention on the bottom end of the pump tubing string (except the sucker-rod string itself) when assembling the pump tubing string in the well, following which the sucker rod string is assembled in the pump tubing string from the top of the well with the hollow polish rod attached to the lower end of the sucker rod string, with the spring latching pump head slideably applied upwardly onto the polish rod and with the pump plunger suspended from the lower end of the polish rod whereby completion of the assembly of the sucker rod string will introduce the internal pump parts suspended thereon into their proper relation to the external pump tubing string supported parts to prepare the pump to start operation.

DETAILED DESCRIPTION OF THE PREFERRED EMBODIMENT

Figure 1:
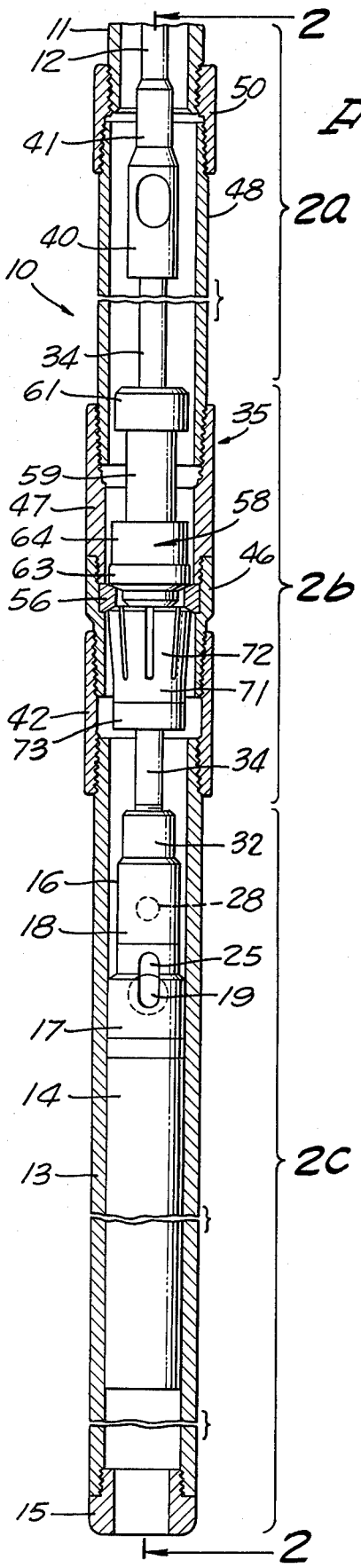
FIG. 1 is a full length general elevational view of the invention taken at an operational point just below its upstroke position.
Figure 3:
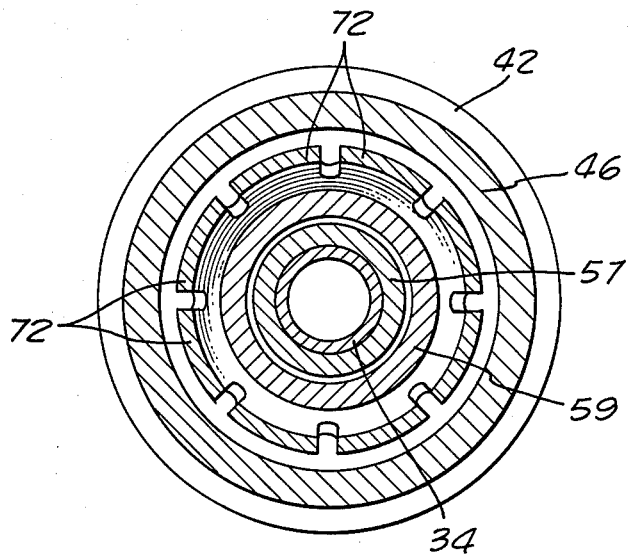
FIG. 3 is a detail cross sectional view taken on line 3—3 of FIG. 2*b* of the annularly expansive spring locking latch of the invention.
Figure 4:
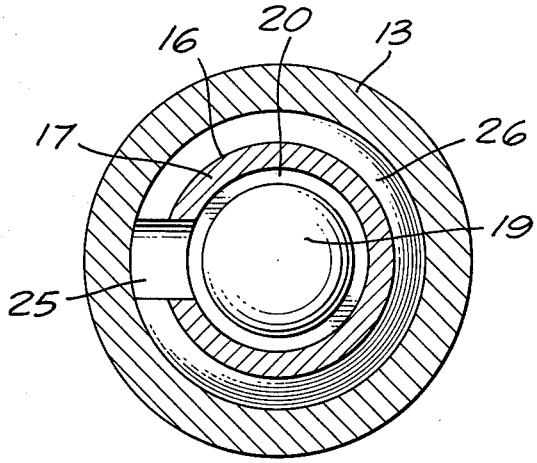
FIG. 4 is a detail cross sectional view taken on line 4—4 of FIG. 2*c* showing the flow pattern through the lower ball valve of the pump plunger into and from the pump head forming chamber.

The deep well pump 10 of the invention is suspended on the bottom end of a pump tubing string 11 and is operated by reciprocation of a sucker rod string 12 assembled within said tubing string. The pump includes a uniformly cylindrical tubular pump barrel 13 within which a tubular pump plunger 14 is slidably trapped against being accidentally lost downwardly by a short hollow internal stop screw 15.

Near its upper end, the plunger 14 has a decreased outside diameter 16 which portion of the plunger embodies lower and upper tandem ball valve cages 17 and 18. The lower cage 17 confines a ball 19 which gravitates centrally onto a coaxial bottom valve seat 20 to close said seat during upstrokes of the plunger as shall be made clear later.

The lower cage has a narrow lateral liquid flow passage 25 connecting it with an annular pumping chamber 26.

The lower valve cage 17 has a screen 27 to prevent interference between ball 19 and an upper ball 28 confined in upper valve cage 18 between a valve seat 29 and an upper screen 30, the latter communicating axially upwardly with an externally threaded nipple 31 covered by a cap 32, a tapped axial hole 33 in which, receives the threaded lower end of a hollow polish rod 34.

The upper end of the pump barrel 13 is externally threaded and is screw connected by a tubular adapter assembly 35 to the lower end of pump tubing string 11. The upper end of the hollow polish rod 34 is provided with a threaded sucker rod adaptor 40 for use in screwing it into the lowermost terminal rod end socket 41 of the sucker rod string 12 and thus permitting reciprocation of polish rod 34 through the sucker rod string 12.

Figure 2A:
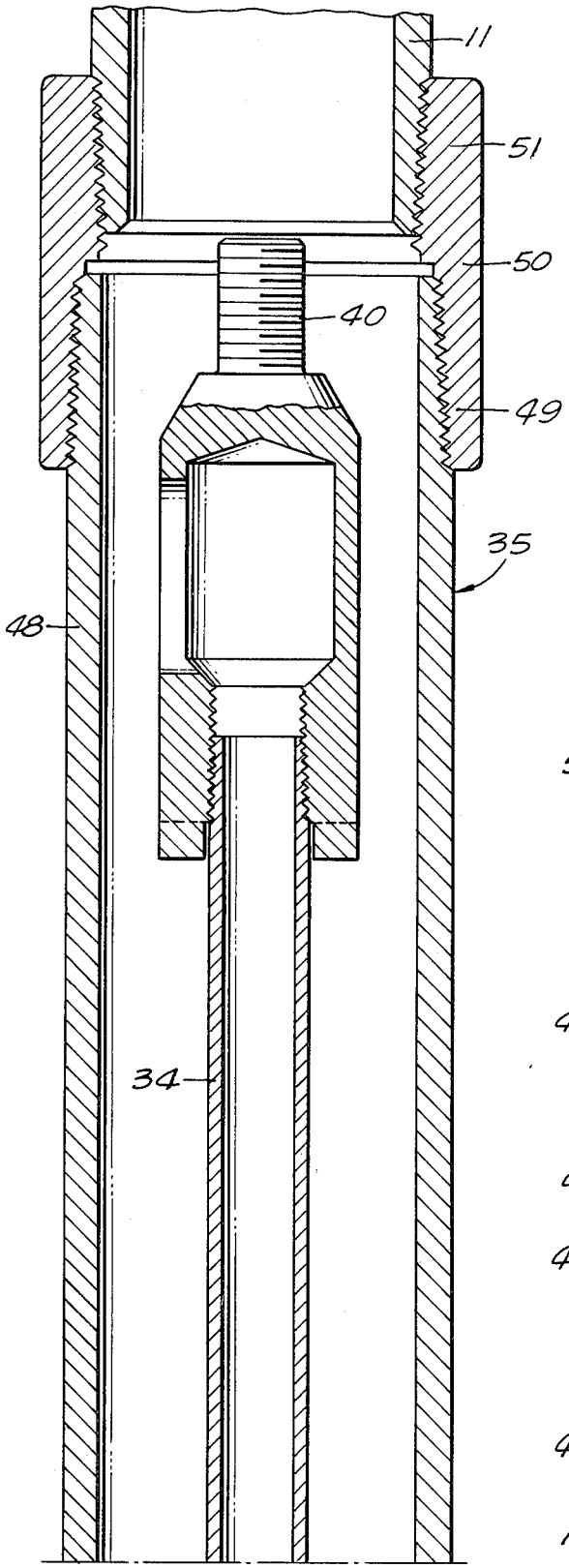
FIG. 2*a* is an enlarged vertical sectional view taken on the line 2—2 of FIG. 1 of the portion indicated by bracket 2*a*, taken at an operational point where the sucker rod string has just been unscrewed from the polish rod.
Figure 2B:
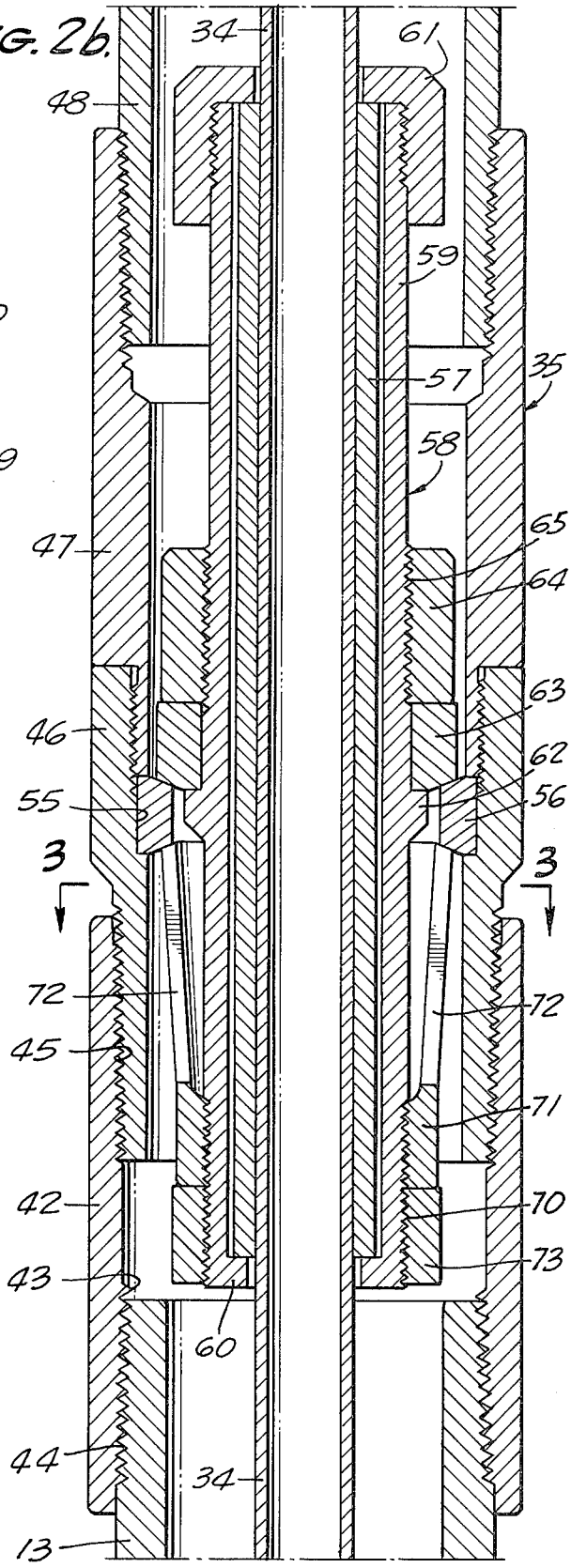
FIG. 2*b* is a similar view of the portion of FIG. 1 indicated by bracket 2*b*.
Figure 2C:
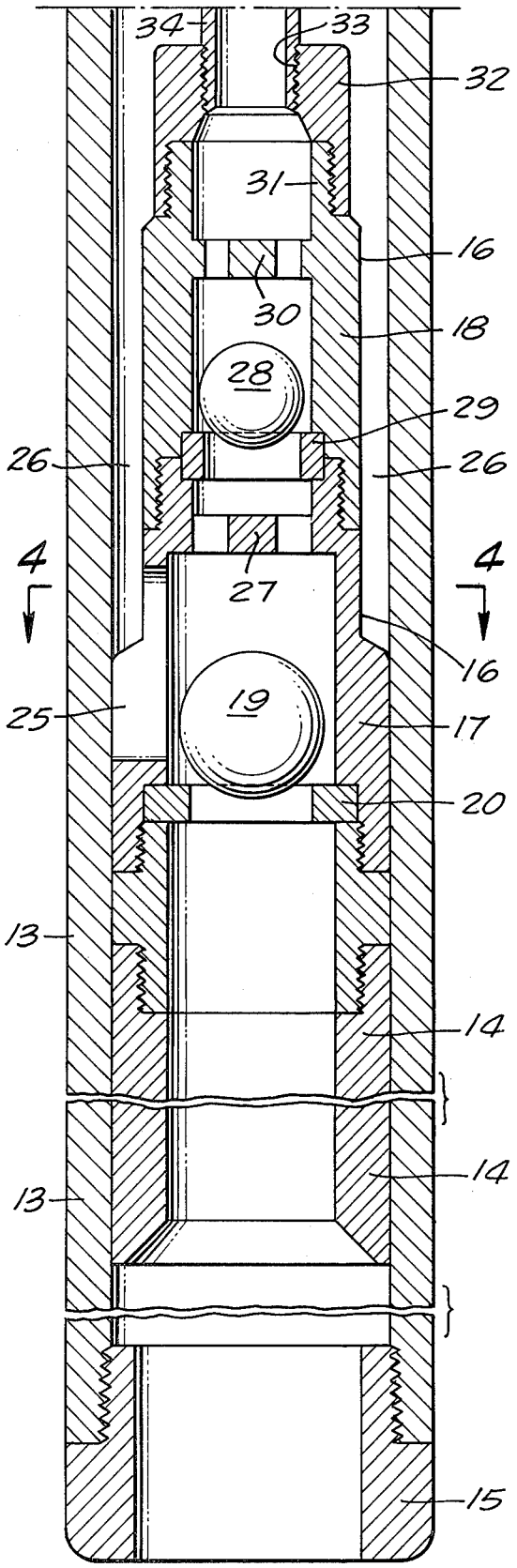
FIG. 2*c* is a similar view of the portion of FIG. 1 indicated by bracket 2*c*, taken at a neutral operational point where the tandem ball plunger valves are both sinking onto their seats.
Figure 5:
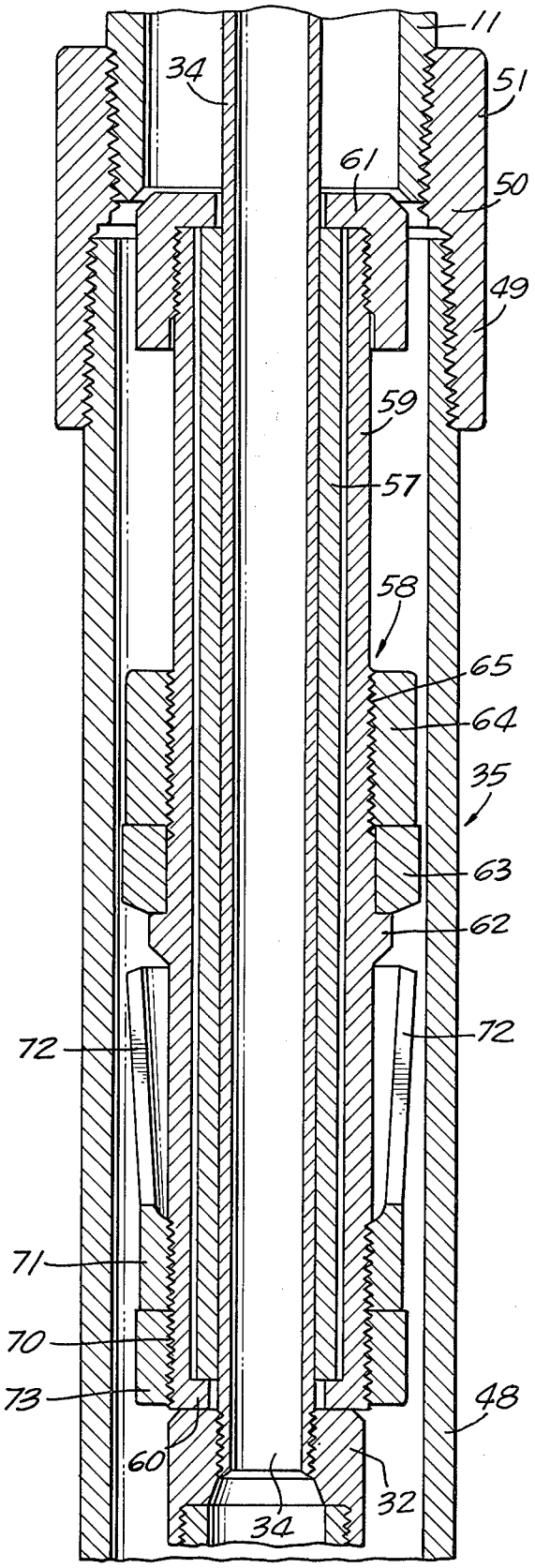
FIG. 5 is a longitudinal sectional view similar to FIG. 2*b* taken at an operational point wherein the pump head annular seal has been opened by a protracted strain on the sucker rod string to open the pump assembly to drain back into the well the column of fluid which has been accumulated in the pump tubing string by the pumping of the well.

The tubular adapter assembly 35 (See FIGS. 1, 2*a*, 2*b*, and 5) includes a thin walled internally pipe threaded pipe coupling 42 the lower threads 43 of which screw on to the threads 44 provided externally on the upper end portion of pump barrel 13. The upper threads 45 on coupling 42 have a substantially greater pitch diameter than threads 44 to facilitate correspondingly increasing the internal diameter of the tubular adapter assembly 35 over that of pump barrel 13, (for reasons to be explained later).

The elements of assembly 35 so affected include annulus clamping lower and upper interscrewing subs 46 and 47 and an oil draining extension sleeve 48, the lower externally threadedend of which screws into the internally threaded upper end of the upper annulus locking sub 47, and the externally threaded upper end of extrusion sleeve 48 screws into the large ID lower end 49 of an adapter pipe collar 50, the small ID upper end 51 of which fits the lower end of pump tubing string 11.

Nested firmly in an internal recess 55 formed in annulus locking subs 46 and 47 is a double bevelled metal annulus 56, the ID of which is preferably larger than the ID of pump barrel 13.

Surrounding the hollow polish rod 34 and having a central sleeve 57 making a sealing fit therewith is a pump head 58. This head has a tubular body 59 externally threaded at its upper and lower ends and midway therebetween and having an internal lip 60 at its lower end supporting sleeve 57, and a screw cap 61 confining said sleeve at its upper end. An external annular rib 62 is integrally extruded from body 59. A bottom bevelled sealing ring 63 is pressed downwardly on annulus 56 by a nut 64 being screwed down on the medial threads 65 on body 59, so as to support head 58 on annulus 56.

Screwed upward adjustably on lower external threads 70 on body 59 is a nut 71 carrying a circumferentially spread series of spring latch blades 72 so that said blades are spring swung outwardly below and in axially latching positions to form a sealing interlock between annulus 56, and pump head 58 which is adjustably fixed by a lock nut 73 and allowed to continue throughout a normal operating season for the pump 10.

When servicing of this pump is required it is removed to the ground surface for this purpose by (a) halting the reciprocating of the sucker rod string (b) placing a steady upward strain on the rod string sufficient to cam inwardly the locking blades 72, thereby freeing the head 58 to be lifted to the level where the plunger 14 is withdrawn from the pump barrel 13 and a continuous bypassing free space is formed around the pump head 58 and plunger 14 through which all the oil occupying the pump tubing string 11 may drain into the well, leaving the tubing string dry ready for separate dry withdrawals of the sucker rod string and the pump tubing string for the servicing of the operative parts at the ground level.

As previously pointed out various options are open to the management in installing the present invention. The design of the invention is aimed at making any of these options equally available.

For instance, a pump tubing string may be elected having an ID which will accept lowering the pump plunger and pump head from the ground level attached to the sucker rod string. When the time then comes for servicing the plunger and pump head, this can be effected merely by removal of the sucker rod string, a much less expensive mode than a dry removal and later replacement of both sucker rod and pump tubing strings.

On the other hand, where the only pump tubing available has an ID which is inadequate for electing the first withdrawal option, the sucker rod string may be used to drain the pump tubing string, following which the sucker rod string can be unscrewed from the upper end of the polish rod, then removed from the pump tubing string, and the latter then withdrawn dry for servicing the pump at the ground level.

Under the latter option the pump may readily be returned to operational service by an exact reverse procedure.

We claim:

1. In a deep well pump adapted to be mounted on the lower end of a pump tubing string and operated through a connection made with the lower end of a sucker rod string extending downwardly through said pump tubing string, the combination of:

a pump barrel open at its lower end for the free entry thereinto or exhaust therefrom of well fluid;

a tubular adapter assembly screw connecting at its lower end to the top of said barrel and provided at its upper end with screw means for being connected to the lower end of a pump tubing string;

an internally upwardly bevelled annulus means mounted within said adapter assembly a tubular pump head normally extending downwardly at least partly through said annulus means and resting downward on and making a sealing downward engagement with said annulus means;

latch means carried by said head for inwardly yieldingly engaging said annulus means from beneath to effectively latch said head against withdrawal upwardly from said connection with said annulus means but permitting said head to be so withdrawn by a continued upward strain on said head; said head having an axial bore;

a hollow plunger slidable in said barrel;

a hollow polish rod connecting coaxially at its bottom end to the top of said plunger and extending coaxially upwardly slidably through the bore of said head to close off a pumped oil compression chamber confined by the top of the pump plunger, the pump barrel between the pump plunger and the sealing annulus means, the pump head and the portion of the hollow polish rod located at the moment between said head and said plunger;

means at the upper end of the hollow polish rod adapting the same to be screw connected to the lower end of a sucker rod string while providing for the discharge into the pump tubing string of the oil delivered upwardly to the lower end of the sucker rod string; and a tandem pair of check valves mounted in superposed relation within an upper end portion of said plunger, the lower valve opening to receive oil from beneath through the plunger on its down stroke, the upper valve closing on the down stroke to divert said oil laterally to the oil compression chamber, the upstroke of the plunger reversing the valve positions to positively force the oil from the compression chamber into the space between the two valves thus hydraulically closing the bottom valve and opening the upper valve from which the oil has nowhere to go except up the polish rod and pump tubing string;

the tubular adapter assembly being of sufficient length and adequate in internal diameter to provide a pump head and plunger bypassing drain chamber when said head and plunger are withdrawn upwardly from said barrel and through said annulus means.

2. A combination as recited in claim 1 wherein said pump plunger, hollow polish rod and pump head with its associated yieldable annulus locking-in means are assembled and connected as a unit to the lower end of the sucker rod string at the start of assembling the latter and lowered progressively to consummate the assembly of the pump incidental to the completion of the assembly of the sucker rod string within said pump tubing string.

* * * * *